US005170812A

United States Patent [19]

Caillat

[11] Patent Number: 5,170,812

[45] Date of Patent: Dec. 15, 1992

[54] CLIP FOR HOLDING DOWN A PIECE OF FABRIC

[76] Inventor: Christiane Caillat, 27, Chemin du Pétray CH-1245, Collonge-Bellerive, Switzerland

[21] Appl. No.: 743,423

[22] PCT Filed: Dec. 21, 1990

[86] PCT No.: PCT/CH90/00290

§ 371 Date: Oct. 10, 1991

§ 102(e) Date: Oct. 10, 1991

[87] PCT Pub. No.: WO91/10030

PCT Pub. Date: Jul. 11, 1991

[30] Foreign Application Priority Data

Dec. 21, 1989 [CH] Switzerland ..... 4585/89

[51] Int. Cl.[5] ..... E04H 15/62

[52] U.S. Cl. ..... 135/118; 24/453; 411/508

[58] Field of Search ..... 135/118; 24/453, 454, 24/460; 411/508, 477, 451, 913; 52/155

[56] References Cited

U.S. PATENT DOCUMENTS

| | | | |
|---|---|---|---|
| 427,815 | 5/1890 | Wolf | 135/118 X |
| 2,647,718 | 8/1953 | Disera | 135/118 X |
| 2,719,452 | 10/1955 | Jones | 411/451 |
| 2,939,468 | 6/1960 | Boyce | 135/118 X |
| 4,289,058 | 9/1981 | Paskert | 411/451 |
| 5,084,944 | 2/1992 | Hileman | 411/508 X |

*Primary Examiner*—David A. Scherbel
*Assistant Examiner*—Lan Mai
*Attorney, Agent, or Firm*—Kane, Dalsimer, Sullivan, Kurucz, Levy, Eisele and Richard

[57] ABSTRACT

The clip comprises an arm (4) and an elongate portion (1) intended to be brought against each other in order to grip the edge of a piece of fabric between jaws (2 and 3). The elongate portion (1) and the arm (4) are then driven into soft ground so that the fabric is held down against the wind.

4 Claims, 1 Drawing Sheet

FIG.1
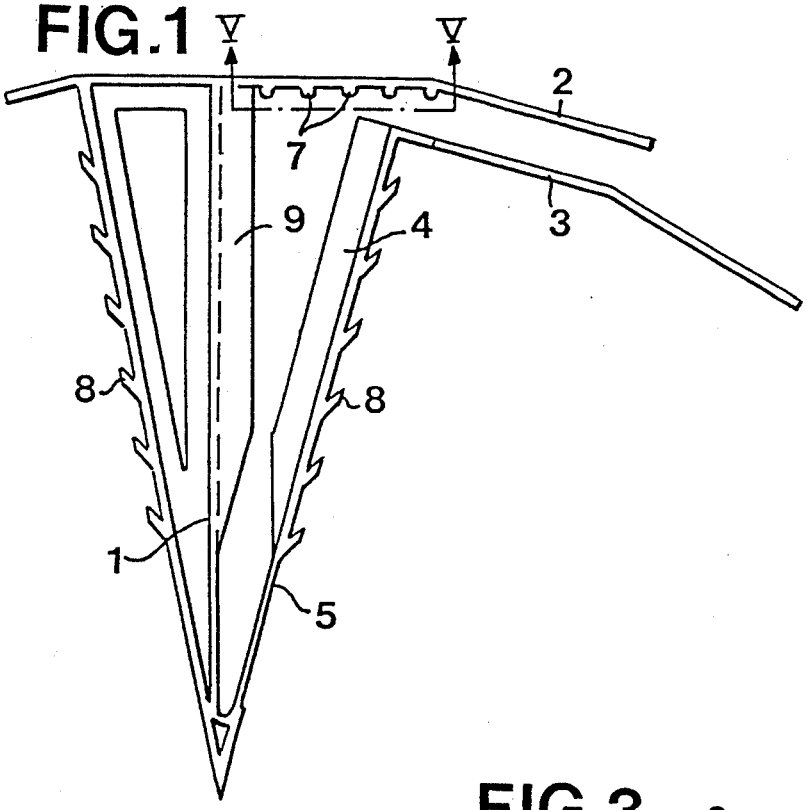
FIG. 2
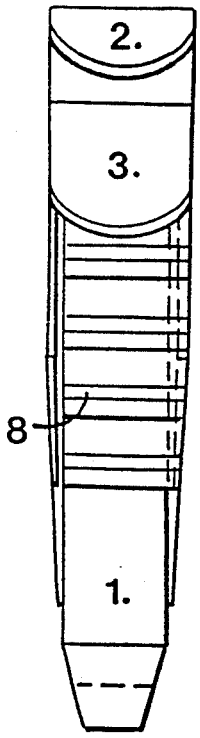
FIG.3
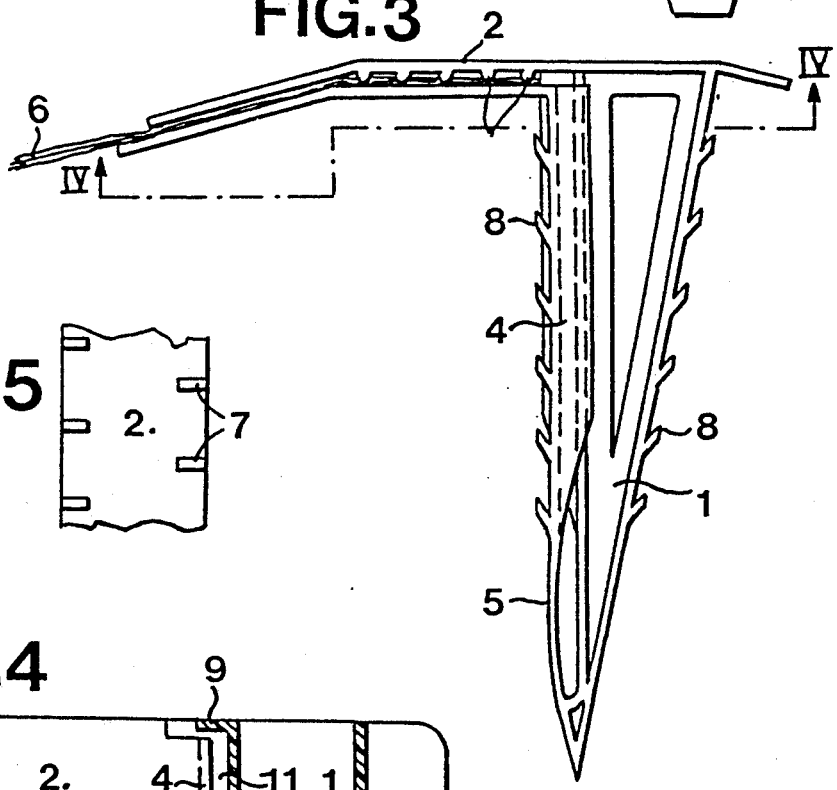
FIG.5
FIG.4
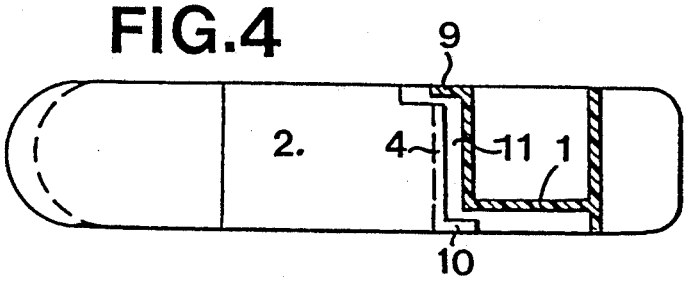

CLIP FOR HOLDING DOWN A PIECE OF FABRIC

It is known that many people like to make the most of nature but often wish to stretch out on a blanket or a towel. However, when such a piece of fabric is placed on the ground and the wind blows, the piece of fabric is lifted or even flies away when a person is no longer on it.

The invention aims to remedy this disadvantage. To this end, the invention relates to a clip for holding in position a piece of fabric placed on the ground, such as defined in claim 1.

The attached drawing shows diagrammatically and by way of example an embodiment of the clip forming the subject of the invention.

FIG. 1 is a view in the non-utilization position.

FIG. 2 is a lateral view of FIG. 1.

FIG. 3 shows the clip in the utilization position.

FIG. 4 is a view according to the line IV—IV in FIG. 3.

FIG. 5 is a partial view according to the line V—V in FIG. 1.

The clip, which is made of synthetic resin, comprises an elongate portion 1 which is intended to be driven into the ground, for example into sand or earth. On its upper part, this elongate portion 1 has an upper jaw 2, facing which there is another jaw 3 supported by the end of an arm 4 which is formed in one piece with the elongate portion 1. The connection between this portion and the arm 4 is constituted by a part 5 in the form of a strip which is sufficiently flexible to allow pivoting of this arm.

By virtue of this pivoting, the arm 4 can assume the position shown in FIG. 3. By this movement, the jaw 3 is brought towards the jaw 2, which makes it possible to grip between these two jaws the edge of a piece of fabric 6.

The lower face of the jaw 2 has projections 7 which are also visible in FIG. 5 and which make possible a better grip of the clip on the fabric 6. Similarly, the elongate portion 1 and the arm 4 have oblique transverse ribs 8 which constitute projecting parts intended to penetrate into the ground to improve the retention of the clip in the latter and to prevent it coming up again.

Lastly, as can be clearly seen in FIG. 4, the portion 1 has a lateral flap 9, while the arm 4 has a lateral flap 10 on the opposite side of the clip. Thus, in the closed position of the clip, these flaps 9 and 10 prevent the sand or the earth penetrating into the space 11 which is comprised between the portion 1 and the arm 4.

In order to hold a piece of fabric on the ground, it is only necessary to place preferably a number of clips on the edge of this piece of fabric, to pivot the arm 4 to bring about the gripping of this piece of fabric between the jaws 2 and 3, then to drive the portion 1 and the arm 4, which are folded in, into the earth or the sand.

It is understood that numerous alternative embodiments could be envisaged, for example with gripping jaws which are displaceable towards each other by the action of a spring or also by a screw with a knurled head or with wings. The clip could of course be envisaged in another material than synthetic resin, but the embodiment described is very advantageous because the clip can be produced by injection into a mold in one single operation.

I claim:

1. Clip for holding in position a piece of fabric placed on the ground, comprising an elongate portion intended to be driven into the ground, said elongate portion having an upper part and a lower end, said portion supporting on said upper part a first jaw of a clip, a second jaw being arranged so as to be capable of coming into contact with said first jaw to grip between them an edge of said piece of fabric, said second jaw being situated below said first in the utilization position of the clip, wherein said the second jaw is supported by an arm, having and end is located opposite the jaw and connected by a flexible strip to said lower end of said portion.

2. Clip according to claim 1, wherein said first and second jaws and said elongate portion are in one single piece made of synthetic resin.

3. Clip according to claim 2, wherein at least on of the arm and said portion have lateral flaps intended to ensure an at least partial closure of the space comprised between said portion and said arm, at least when they are in the utilization position, in order to prevent the introduction of earth or of sand into this space.

4. Clip according to claim 1 or 2, the arm and/or said portion are provided with projecting parts intended to penetrate into the ground to improve the retention of the clip in the ground.

* * * * *